US007341271B2

(12) United States Patent
Bünter

(10) Patent No.: US 7,341,271 B2
(45) Date of Patent: Mar. 11, 2008

(54) SKI SPOT APPARATUS WITH INTEGRATED FORCE TRANSMISSION SYSTEM

(76) Inventor: Roland Bünter, Ulmenweg 3b, CH-8856 Tuggen (CH)

( * ) Notice: Subject to any disclaimer, the term of this patent is extended or adjusted under 35 U.S.C. 154(b) by 165 days.

(21) Appl. No.: 10/680,708

(22) Filed: Oct. 7, 2003

(65) Prior Publication Data

US 2004/0135327 A1 Jul. 15, 2004

Related U.S. Application Data

(63) Continuation-in-part of application No. 09/914,275, filed on Jan. 15, 2002, now Pat. No. 6,648,362.

(51) Int. Cl.
*A63C 5/07* (2006.01)

(52) U.S. Cl. ..... 280/602; 280/607

(58) Field of Classification Search ..... 280/601, 280/602, 607, 609, 610, 11.14, 841, 14.21
See application file for complete search history.

(56) References Cited

U.S. PATENT DOCUMENTS

| | | | | |
|---|---|---|---|---|
| 3,797,839 A | | 3/1974 | Smolka et al. | |
| 3,797,844 A | | 3/1974 | Smolka et al. | |
| 4,141,570 A | | 2/1979 | Sudmeier | |
| 4,269,431 A | | 5/1981 | Weigl | |
| 4,294,460 A | | 10/1981 | Kirsch | |
| 4,353,575 A | | 10/1982 | Brice | |
| 4,526,397 A | | 7/1985 | Richert | |
| 4,556,237 A | * | 12/1985 | Meatto et al. | 280/610 |
| 4,565,386 A | | 1/1986 | Crainich | |
| 4,647,061 A | * | 3/1987 | Girard | 280/602 |
| 4,679,813 A | * | 7/1987 | Girard | 280/602 |
| 4,706,985 A | * | 11/1987 | Meatto | 280/610 |
| 4,804,200 A | | 2/1989 | Kuchler | |
| 4,878,686 A | * | 11/1989 | Quaggiotti | 280/602 |
| 4,934,669 A | | 6/1990 | Bourdeau et al. | |
| 4,979,761 A | | 12/1990 | Rohlin | |
| 5,046,751 A | | 9/1991 | Scherubl | |
| 5,129,668 A | | 7/1992 | Hecht | |
| 5,269,555 A | | 12/1993 | Ruffinengo | |

(Continued)

FOREIGN PATENT DOCUMENTS

EP 0 230 989 8/1987

(Continued)

*Primary Examiner*—Christopher P. Ellis
*Assistant Examiner*—Bridget Avery
(74) *Attorney, Agent, or Firm*—Pauley Petersen & Erickson

(57) ABSTRACT

A ski sport apparatus having a ski with a middle section and two outer sections. An interface device connected to the ski, with a binding region for accommodating a ski binding is arranged in the middle section. The ski sport apparatus has at least two force introduction regions distanced to one another in the longitudinal direction, for introducing forces from the interface device into the ski. The ski in the longitudinal direction has several regions of lower or higher flexibility alternating in the longitudinal direction. The middle section of the ski has a region with a higher flexibility. A frontmost and/or a rearmost force introduction region is allocated to a region with a lower flexibility of the ski and in the longitudinal direction is arranged further to the front or further to the rear than the binding region. The ski has good curve dynamics, has a good ski guiding and excels with an incomparable running smoothness.

26 Claims, 10 Drawing Sheets

U.S. PATENT DOCUMENTS

| | | | | | |
|---|---|---|---|---|---|
| 5,275,428 | A | * | 1/1994 | Bejean et al. | 280/602 |
| 5,280,942 | A | * | 1/1994 | Ruffinengo | 280/602 |
| 5,301,965 | A | * | 4/1994 | Floreani | 280/600 |
| 5,320,377 | A | * | 6/1994 | Ruffinengo | 280/602 |
| 5,326,126 | A | | 7/1994 | Ruffinengo | |
| 5,344,176 | A | * | 9/1994 | Trimble | 280/602 |
| 5,395,132 | A | | 3/1995 | Abondance et al. | |
| 5,413,371 | A | * | 5/1995 | Trimble | 280/602 |
| 5,437,468 | A | | 8/1995 | Schenner | |
| 5,540,458 | A | * | 7/1996 | Arduin et al. | 280/602 |
| 5,647,605 | A | | 7/1997 | Arduin | |
| 5,671,939 | A | | 9/1997 | Pineau | |
| 5,775,716 | A | * | 7/1998 | Harsanyi et al. | 280/602 |
| 5,845,923 | A | | 12/1998 | Zanco | |
| 5,915,719 | A | | 6/1999 | Bauvois | |
| 5,984,344 | A | * | 11/1999 | Harsanyi et al. | 280/602 |
| 6,158,747 | A | | 12/2000 | Magnani | |
| 6,382,658 | B1 | * | 5/2002 | Stubblefield | 280/609 |
| 6,659,493 | B1 | * | 12/2003 | Trnka | 280/607 |
| 6,916,035 | B2 | * | 7/2005 | Houser et al. | 280/602 |

FOREIGN PATENT DOCUMENTS

| | | |
|---|---|---|
| EP | 0 607 544 | 7/1994 |
| EP | 0 685 244 | 12/1995 |
| WO | 95/00217 | 1/1995 |
| WO | 99/07450 | 2/1999 |

* cited by examiner

SKI SPOT APPARATUS WITH INTEGRATED FORCE TRANSMISSION SYSTEM

CROSS REFERENCE TO RELATED U.S. PATENT APPLICATION

This U.S. Patent Application is a continuation-in-part patent application of U.S. patent application having Ser. No. 09/914,275, filed on 15 Jan. 2002, now U.S. Pat. No. 6,648,362 entitled SKI GUIDE PRESSURE INTENSIFIER PLATE (SNOW-SPEED).

BACKGROUND OF THE INVENTION

1. Field of the Invention

This invention relates to a ski sport apparatus, snowboards or likewise, in the following generally called "skis". The ski according to this invention has extremely good curve dynamics, has an extraordinary ski guiding and excels with an incomparable smooth running. The ski according to this invention can maintain tight radii of curvature even with relative tall skiers, with a high stability and a high speed.

2. Discussion of Related Art

A typical conventional ski 3 according to the state of the art is shown in FIG. 1. With a conventional ski 3 the force introduction F1 through the snow sportsman is in the middle 7 of the ski where the ski is at its thickest and/or has a high bending stiffness. To the front and to the rear the ski flex 1, 1' becomes increasingly weaker. A ski 3 which in the binding region 5 has a high bending stiffness and is thick has a good ski guiding and a great smoothness of running. In the curve the bending line of the ski 3 should adapt to the radius of the travelled curve 4. The stabilizing high bending stiffness in the middle of the ski 7 due to the stiffness prevents the formation of a free bending line 6, and lets the ski 3 bend only to a certain radius of the curve to be travelled and thus prevents good curve dynamics. The resulting force, composed of the intrinsic weight of the snow sportsman and the centrifugal force in the curve 4 counteracts a counter force F8 from the ground or snow such that the bending line 6 of the ski 3 in the binding region 5 during the curve 4 is negatively compromised. The ski 3 does not permit the travel of tight radii.

A ski which were to have a lower bending stiffness in the binding region 5, for example were to be designed soft and/or thinly constructed, would have very good curve dynamics. The bending line of such a ski would be optimal. The ski would be able to bend easily and one would be able to travel very tight curves. This direction was followed in the broadest sense in the U.S. Patent Publication 2001/0,035,630 (Cuzzit et al.) and the U.S. Pat. No. 6,325,404 (Liard et al.) because the bending stiffness or the bending in the longitudinal axis of the ski together with the ski binding device is redefined as a unit because the force of the bending stiffness which the ski binding creates was eliminated in the ski. However, the two newly defined bending stiffness of the ski and of the ski binding plate again correspond to the usual standards of current conventional skis. If one reduces the bending stiffness in the middle of the ski, the front and rear contact pressure Fp (see FIG. 1) is reduced. This means that the ski guiding is poor at the front and at the rear on the ski. The ski is unstable, the running smoothness is considerably worsened. In order to prevent a fluttering, the ski is constructed shorter which again leads to a poor guiding of the ski at a high speed.

The positive characteristics, specifically good ski guiding and good curve dynamics apparently cannot be unified.

Longer skis have a good ski guiding and worse curve characteristics, while shorter skis have good curve dynamics and worse ski guiding. One may only optimize a good setting by weighing up the positive properties such as good curve dynamics and a good ski guiding.

SUMMARY OF THE INVENTION

It is one object of this invention to provide a ski which unifies good ski guiding with good curve dynamics and optimizes these without inhibiting these positive characteristics. With a longer ski with a high stability, tighter radii of curvature are to be able to be travelled at a high speed.

The ski according to this invention is defined in this specification and in the claims and achieves these and other objects. The force introduction of the user or snow sportsman by an interface device which may be integrated above the ski, on the ski or in the ski, is accomplished via at least two outer force introduction regions outside the ski-binding region further to the front or rear, on the ski. The ski in the middle is thinner and/or softer and/or has a lower bending stiffness than a conventional ski. Thus it may bend to a greater extent and more easily, which contributes to good curve dynamics. The ski is thus designed for an active action means for interactive force transmission from the front and rear ski flex to the middle of the ski and vice versa. The ski at the force introduction regions is thick and/or here has a high bending stiffness. Proceeding from the force introduction regions the bending stiffness in both directions of the longitudinal axis of the ski is normally again gradually reduced according to the type of ski. The bending line of the ski is thus actively optimized under the variously acting forces during the travelled curve. The force introduction of the user or snow sportsman onto the ski is effected via the following different variations.

1. Via a ski guide pressure reinforcement plate with/without length compensation, by which the ski may extend out below the plate.
2. Via a ski guide pressure reinforcement plate with/without length compensation and one or more wedge functions, by which the ski may extend out below the plate.
3. Via a ski guide pressure reinforcement plate with/without length compensation, which may bend and thus act as a leaf spring for springiness and/or damping.
4. Directly via the ski shoe and the ski binding, which permits a length compensation.
5. Via an interface plate with/without length compensation which is integrated on or in the ski.
6. Via a ski guide pressure reinforcement plate which in its bending stiffness is computed such that during the curve it may bend just as much during so that it corresponds to the predefined radius of the ski, specifically such that during the travelled curve in the middle of the ski it slightly contacts the ski. This embodiment ensures that the main force introduction is effected via the corresponding force introduction regions. This plate is firmly assembled on the ski or forms a unit with the ski, for example because it is adhered to the ski.
7. The ski guide pressure reinforcement plate is computed with a bending stiffness as in point 6, but integrated in the ski.
8. One makes do without a ski guide pressure reinforcement plate. Instead the bending stiffness of the plate computed according to point 6 is implemented or calculated into the thickness or bending stiffness of the ski, so that it is ensured that the main force introduction is effected via the force introduction regions.

The above mentioned embodiments of the ski guide pressure reinforcement plate may be provided with the fastening means and/or the compensation means and/or the active means as one piece and/or with resilience means and/or shock absorbing means at the force introduction regions. The resilience means and/or shock absorbing means preferably comprise a compression or tension spring and/or an air or oil cylinder or another elastic or damping element. The ski guide pressure reinforcement plate is manufactured in the form of at least one plate, at least one rail, at least one tube and/or other elements, and accommodates a ski binding or is integrated into a ski binding, or the ski binding is integrated on or in the ski or on or in the ski guide pressure reinforcement plate or plate, rail, tube or other element. The ski, the ski guide pressure reinforcement plate, the rail, the tube or the other elements may be designed such that a ski binding may be pushed on and/or the ski binding is displaceable in the longitudinal direction and/or the length compensation of the ski binding is ensured in or on the ski or in or on the plate or rail, the tube or the other elements.

With the cited force introduction possibilities, on the one hand a larger pressure is produced at the front and rear on the ski, by which an extraordinarily direct ski guiding and a revolutionary grip are produced, and vibrations are better absorbed which provides the ski with an incomparably good running smoothness. The bending stiffness of the ski is reduced in the middle of the ski compared to a conventional ski, by which the ski may bend better. The radius of the curve is thus determined not only by the setting, but also by the bending line of the ski. The more pressure is given, the more the ski is bent and accordingly the radius to be travelled becomes tighter. If the ski guide pressure reinforcement plate is not a unit with the ski, for example is not adhered to the ski or integrated in the ski, the ski, the tighter the curve travelled does not become increasingly harder and does not reach a bending limit. It is thus easy to travel, having extreme curve dynamics which has a positive effect in the carving region.

The ski sport apparatus according to this invention has a ski defining a longitudinal direction with a middle section and two outer sections and an interface device with a binding region for accommodating a ski binding, the interface device is arranged in the middle section and connected to the ski, at least two force introduction regions are distanced to one another in the longitudinal direction for introducing forces from the interface device into the ski. The ski comprises several regions with a higher and lower flexibility alternating in the longitudinal direction. The middle section of the ski comprises a region with a higher flexibility. A frontmost force introduction region is allocated to a region with a lower flexibility of the ski and in the longitudinal direction is arranged further to the front than the binding region, and/or a rearmost force introduction region is allocated to a region with lower flexibility of the ski and in the longitudinal direction is arranged further to the rear than the binding region.

BRIEF DESCRIPTION OF THE DRAWINGS

Preferred embodiments of this invention and, for comparison, of the state of the art are described in detail by the attached drawings.

DESCRIPTION OF PREFERRED EMBODIMENTS

Figure 1:
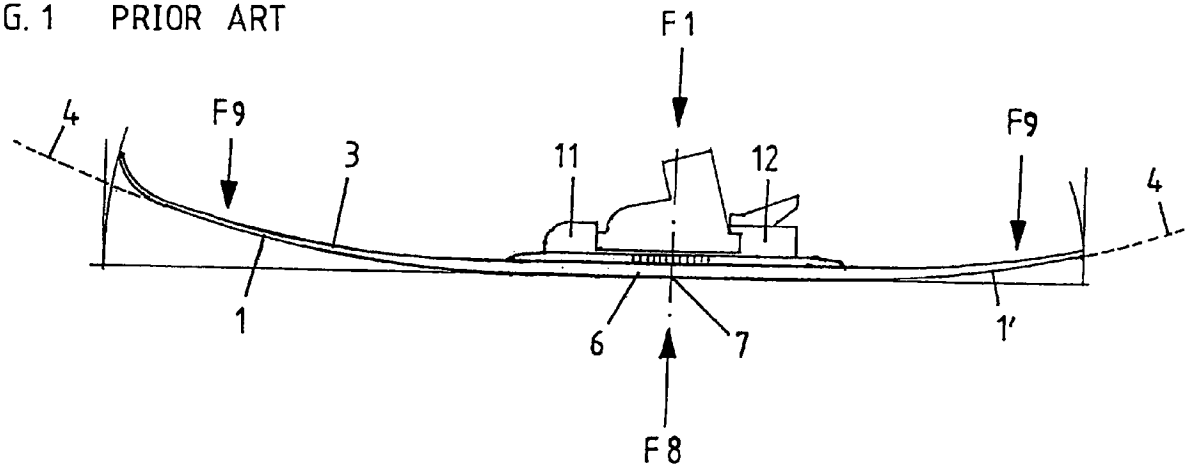
FIG. 1 PRIOR ART
FIG. 1 shows a ski according to the state of the art in a lateral view.
Figure 2:
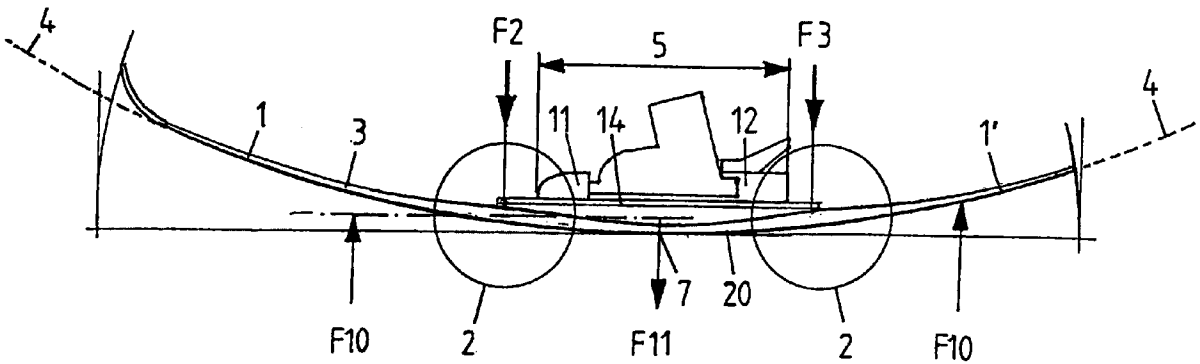
FIGS. 2-14 show various embodiments of the ski according to this invention, in lateral views.

FIG. 2 shows a preferred embodiment form of a ski 3 according to this invention. The force introduction of the unrepresented user or snow sportsman into the ski 3 is effected via a ski guide pressure reinforcement plate 14 which is fastened on the ski 3, at least two or more force introduction regions F2 and F3 further to the front and rear on the ski. For the sake of simplicity only two force introductions are shown in FIG. 2 but there may be more of these (cf. FIGS. 9, 10, and 12). The ski guide pressure reinforcement plate 14 is assembled onto the ski 3 such that the ski 3 may deflect below the plate 14 and may be easily bent so that the plate 14 acts as a leaf spring. The plate 14 may alternatively also be constructed onto the ski 3 such that the ski 3 and the plate 14 form a unit, or the plate 14 may be integrated in the ski 3, or the plate 14 may be implemented or calculated into the bending stiffness of the ski 3 in the form of a computed force which corresponds to the bending stiffness of the plate 14.

The ski guide pressure reinforcement plate 14 comprises a binding region 5 for accommodating a ski binding, for example with a binding head 11 and a heel automatic device 12.

The binding region 5 typically has an extension in the longitudinal direction of maximally 600 mm. Since the front force introduction region F2 is to be arranged further to the front than the binding region 5 and the rear force introduction region F3 further to the rear than the binding region 5, the distance in the longitudinal direction between the front force introduction region F2 and the rear force introduction region F3 is typically at least 650 mm. Preferably a distance of approximately 800 to 900 mm is selected, and maximally approximately 1300 mm.

The middle of the ski 7 without the plate 14 is thinner than with a conventional ski and/or has a lower bending stiffness than a conventional ski and thus may be bent to a greater extent and more easily. The loss of stabilization in the front and rear ski flex 1, 1' which thus arises is more than compensated by the stabilizing ski guide pressure reinforcement plate 14.

The ski 3 is an active means of a force transmission system 2 because the ski 3 in the region 2 of the force introduction F2 and F3 is constructed so thick and/or so strongly and/or has such a high bending stiffness, that an acting force F10 according to the travelled curve 4 to the front and rear on the ski 3 is converted into an active force F11 by a lever principle which becomes active in combination with the ski guide pressure reinforcement plate 14. The active force F1 overcomes the counter pressure F8 from the ground or the snow and ensures an optimal bending line 20 according to the curve 4 to be travelled on the whole length of the ski 3. In order to ensure an optimal force transmission F10 from the front or rear part of the ski 3 to the middle of the ski 3 and to actively optimize the bending line 20 of the ski 3 under the variously acting forces during the travelled curve 4, the ski 3 proceeding from the front force introduction region F2 to the front 1, and from the rear force introduction region F3 to the rear 1' becomes gradually thinner and/or is reduced in bending stiffness so that an optimal swing introduction phase or swing ending phase is possible.

Between the force introduction regions F2 and F3, the ski 3 proceeding from the force introduction regions normally is gradually thinner or reduced in bending stiffness in the direction of the middle 7 of the ski, depending on the type of ski, so that the ski 3 serves as an active acting means because the ski 3 while taking account of all acting forces during the travelled curve 4 bends according to the desired radius of the ski manufacturer and actively optimizes the bending line. The thicknesses and/or bending stiffnesses of the individual regions of the ski 3 are made individually according to the desired ski characteristics and ski types as well as according to the various construction types of the ski manufacturer. The front ski flex 1 is now constructed stronger and longer. The construction types of the various skis 3 are varied and are not cited in detail. This document however includes all ski construction types, monocoque and shell design or sandwich, box and injection construction type or tube or hollow systems or other construction types, and is applied in all ski sport apparatuses, such as alpine skis, mono-skis, carving skis, free-skis, sqwals, snowboards, etc.

Figure 3:
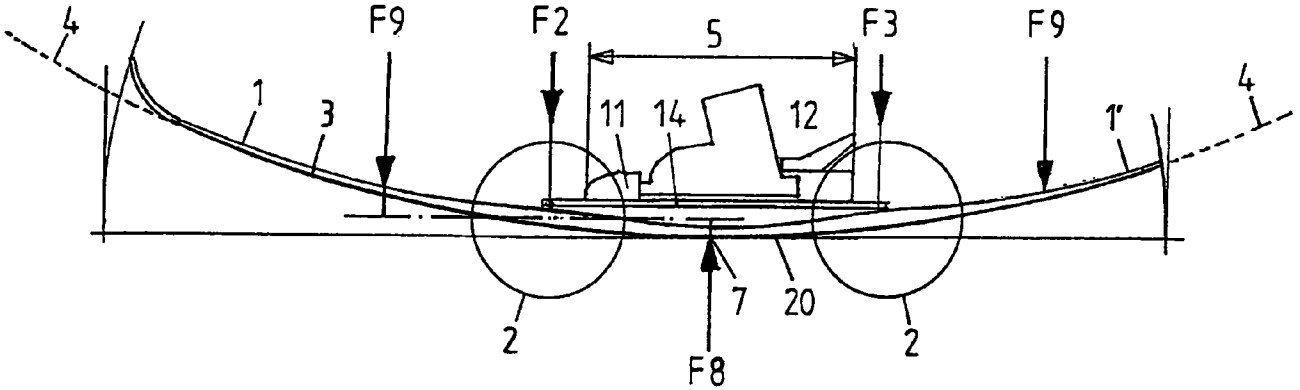

As FIG. 3 shows, in the reverse manner the ski 3 according to this invention acts as an active acting means of the force transmission system 2 because the force introduction regions F2 and F3 in combination with the ski guide pressure reinforcement plate 14 activate lever principles which transmit the counter force F8 from the ground or the snow into a stabilizing contact pressure F9 onto the ski flex at the front 1 and rear 1'. With this there results an excellent ski flex damping which excellently absorbs vibrations and gives the ski an incomparable smooth running, a phenomenal ski guiding and an enormous grip. The user or snow sportsman has an increased safety and an incomparable positive travelling comfort.

Figure 4:
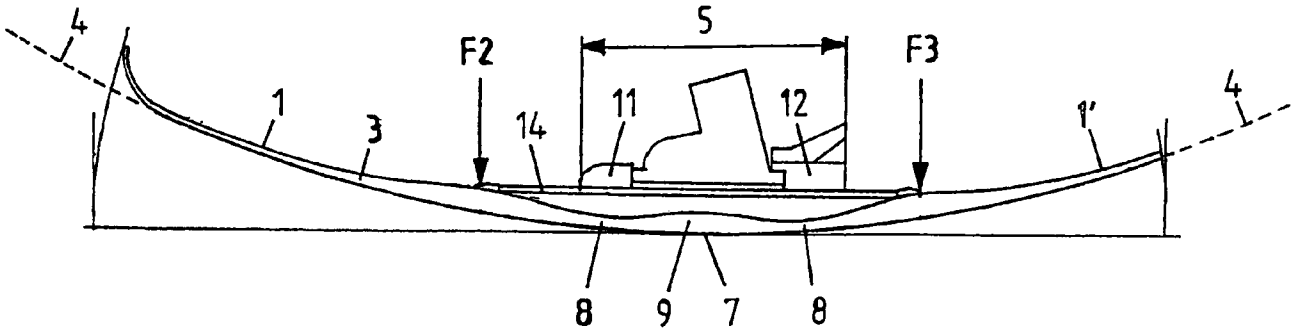

FIG. 4 illustrates that according to the manner of the desired ski type, the extent of the thickness and/or bending stiffness proceeding from the force introduction regions F2 and F3 reduces in the direction of the middle of the ski and may become greater 9 again in the ski middle.

Figure 5:
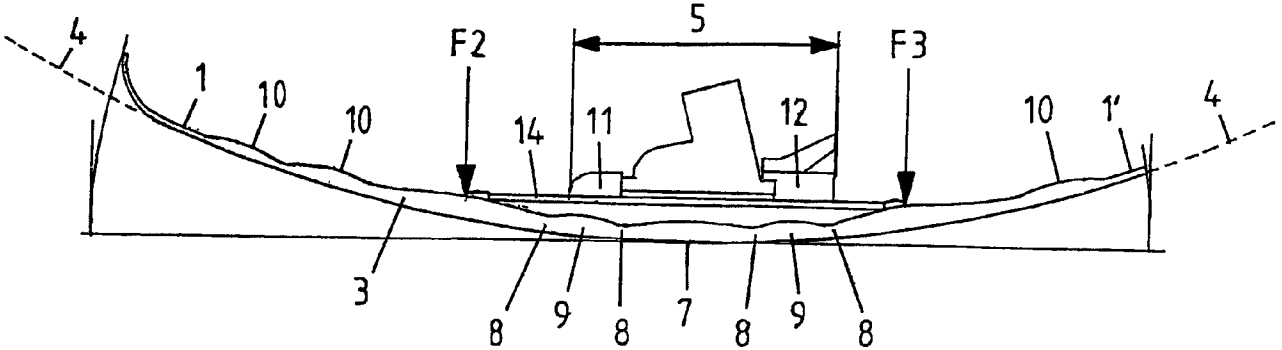

FIG. 5 shows an embodiment form of the ski 3 according to this invention in which the simple arrangement shown in FIG. 4 of various bending stiffness regions 8, 9, 8 between the force introduction regions F2 and F3 is repeated several times, wherein the various bending stiffness regions 8, 9 may also be distanced differently. Thus in comparison to FIG. 4 one achieves an even more efficient force transmission from the front 1 or the rear ski flex 1' according to the acting lever principle 2 via the force introduction regions F2 and F3 of the ski guide pressure reinforcement plate 14 in the direction of the ski middle. Thus under the differently acting forces in the travelled curve one obtains an even more optimally balanced bending line 20 of the ski 3.

In order to achieve an even more efficient ski flex damping and an even better ski guiding than described in FIG. 3, proceeding from the force introduction regions F2 and F3 the thickness and/or bending stiffness of the ski in the direction of the ski flex, the front 1 or to the rear 1', is reduced and then increases again. This arrangement of various bending stiffness regions 10 may be repeated several times, wherein the various bending stiffness regions may be differently distanced. With this one achieves a better force transmission from the ski middle 7 in the direction of the ski flex 1, 1'. Such an arrangement of regions with a lower 10 or higher flexibility alternating in the longitudinal direction is not only advantageous for the ski 3 according to this invention but also for other skis. This arrangement effects a damping of the ski 3 by which means a fluttering of the ski 3 is prevented.

Figure 6:
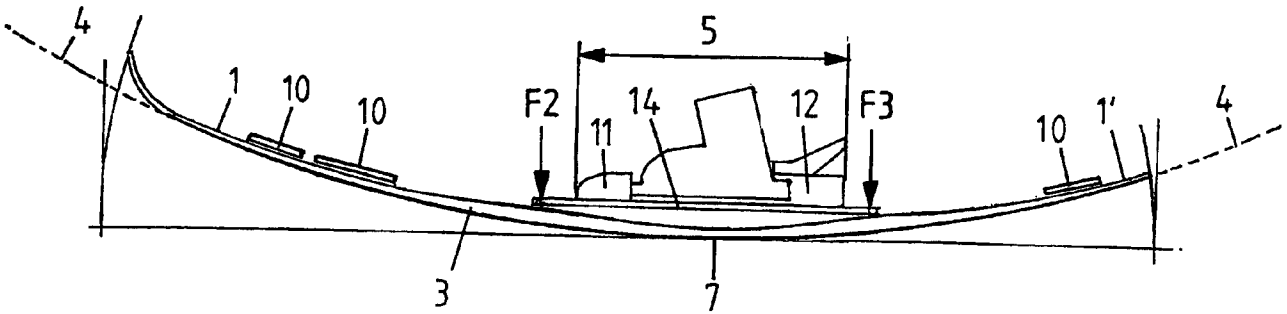

FIG. 6 shows a possible construction type of a ski 3 according to this invention with one or more tabs 10 which for example are manufactured of carbon fiber or are reinforced with carbon fiber and/or may contain other materials. The tabs 10 are attached so that they prevent a length compensation. They fulfill an analogous function as the various bending stiffness regions 10 in FIG. 5. The tabs 10 too may not only be applied to the ski 3 according to this invention but also to other skis with an advantageous effect. They effect a damping of the ski 3 and prevent a fluttering of the ski 3. Such tabs or thickenings 10 may even be applied outside ski construction such as for mechanically damping an elongate structure, for example in engineering, airplane construction or cable-car construction or in other industrial applications.

Figure 7:
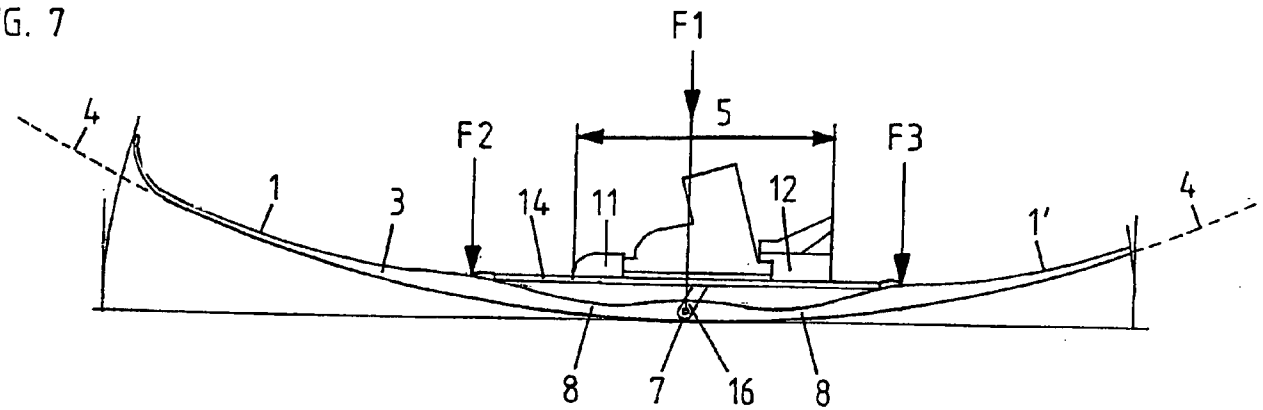

FIG. 7 shows a further embodiment of the ski 3 according to this invention with a plate 14 and with a wedge function 16. The ski 3 has three force introductions F1, F2 and F3. According to the type of the desired ski the extent of the thickness and/or bending stiffness is gradually reduced proceeding from the force introduction regions F1, F2 and F3 in the direction of the middle 8 of the individual force introduction regions.

Figure 8:
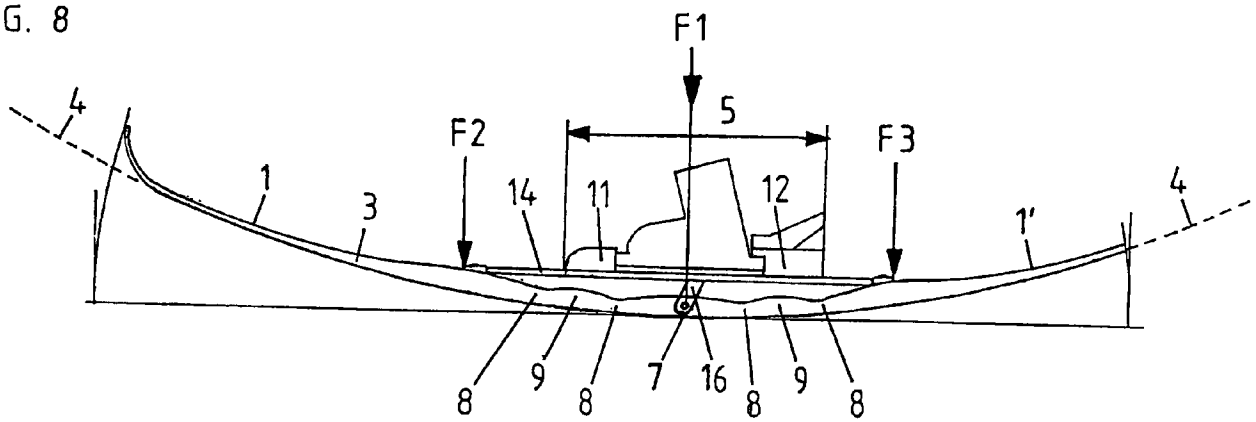

FIG. 8 shows a further embodiment form of the ski 3 according to this invention with a plate 14 in combination with a wedge function 16, as FIG. 7 but provided with the principle of force transmission as in FIG. 5. The thickness and/or bending stiffness thus proceeding from the force introduction regions F2 and F1, or F3 and F1 reduces 8 in the direction of the middle of the individual force introduction regions, and in the middle between the force introduction regions increases 9 again.

Figure 9:
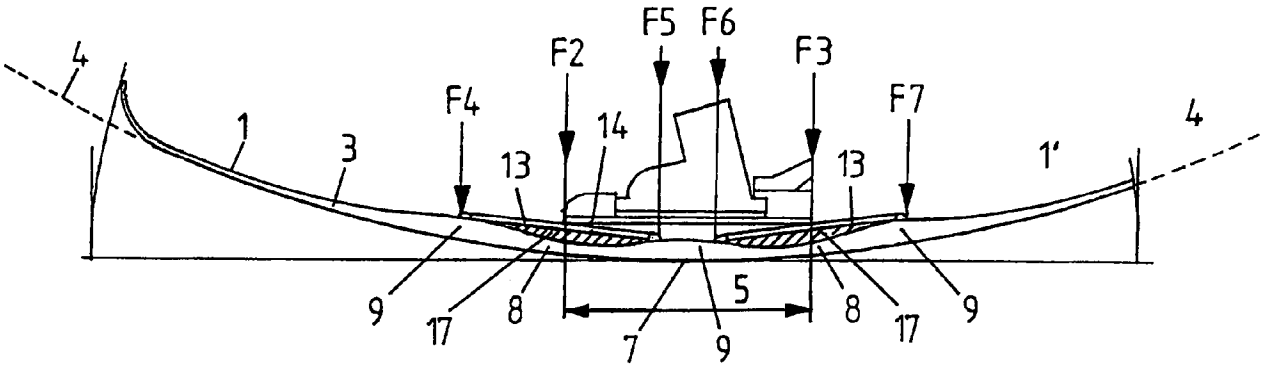

FIG. 9 shows a ski 3 according to this invention with two arranged force transmission tabs 13 which are to assist the forces of the force transmission system 2 as described in view, of FIG. 2 and FIG. 3. The force transmission tabs 13 may be an integral component of the ski 3, assembled on the ski 3 and/or integrated in the ski 3 and may have one or no length compensation and/or at least one joint or elastic connection means 17 to the ski 3 (cf. elements 15, 17 in FIG. 11, 12, elements 17, 19, 21 in FIG. 15; elements 17, 18 in FIG. 16). The force transmission tabs 13 may be arranged as a leaf spring and/or between the tab 13 and the ski 3 may have a resilience and/or damping (cf. elements 15, 17 in FIG. 11, 12; elements 17, 19, 21 in FIG. 15, element 17, 18 in FIG. 16), with a spring, with an elastic or damping element or other elements, by which knocks are damped and absorbed and a rebound is produced. Thus in the curve a restoring force is produced under pressure which causes the ski 3 to return into its original position as quick as possible.

The force introduction of the user or snow sportsman is thus effected via force introduction regions F4, F5, F6, F7 wherein the ski 3 has a large bending stiffness 9. Between the force introduction regions F4, F5 and F6, F7 the bending stiffness of the ski 3 is reduced 8. As shown in FIG. 5 the arrangement of various bending stiffness regions may be repeated several times proceeding from the force introduction regions in the direction of the ski middle 7 or in the direction of the ski flex 1, 1', wherein the force introduction regions may be differently distanced. The arrangement of the tabs 13 may be supplemented at the force introduction regions F4 and/or F5 and/or F6 and/or F7 so that e.g. eight or any greater number of force introduction regions may be arranged on the ski 3.

Figure 10:
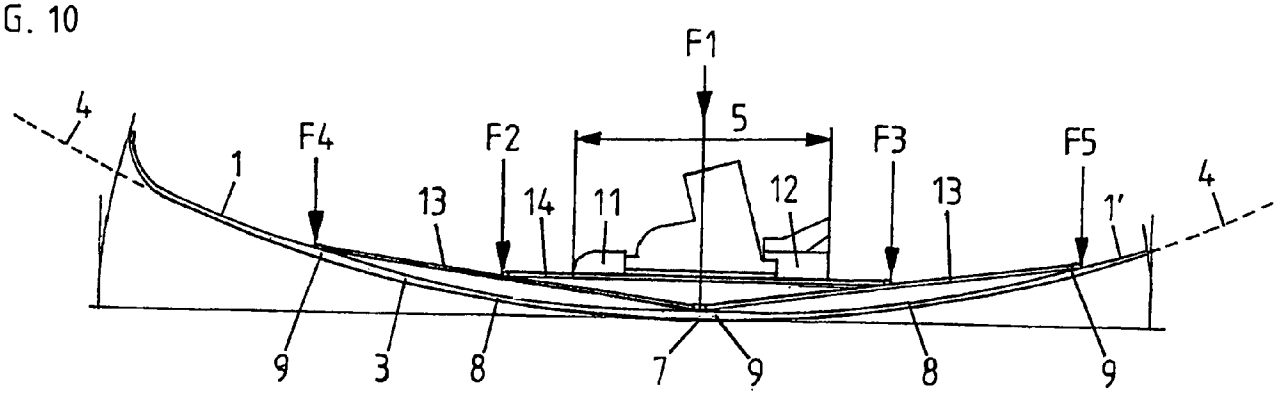

FIG. 10 shows a ski 3 according to this invention with two force transmission tabs 13, similar to that described in FIG. 9. The force introduction of the user or snow sportsman is however effected merely via three force introduction regions F1, F4, F5 where the ski 3 is thick and/or has a large bending stiffness 9. Between the force introduction regions F4, F1 and F1, F5 the bending stiffness of the ski is reduced 8. As shown in FIG. 5 the arrangement of various bending stiffness regions may be repeated several times proceeding from the force introduction regions in the direction of the ski middle 7 or in the direction of the ski flex 1, 1', wherein the force introduction regions maybe differently distanced. The arrangement of the force transmission tabs 13 on the force introduction regions F4 and/or F1 and/or F5 may be infinitely supplemented according to the same principle so that several force introduction regions may be arranged on the ski 3.

Figure 11:
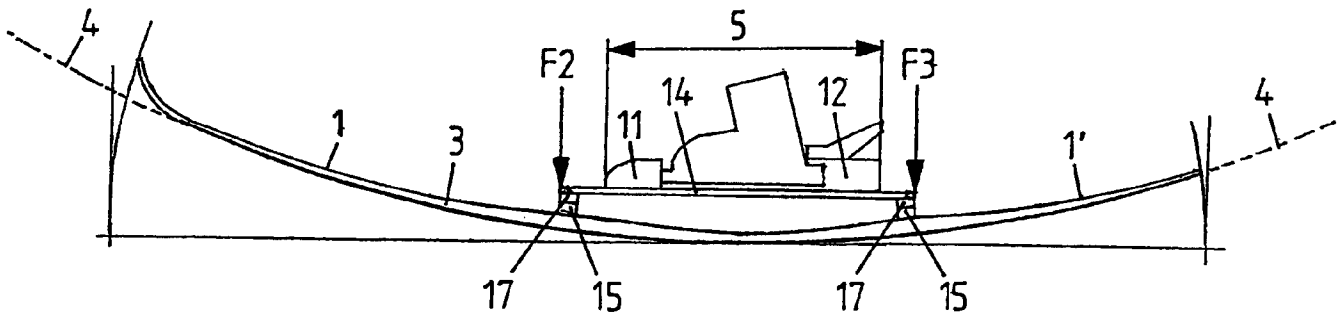

FIG. 11 shows a ski 3 according to this invention described by way of FIGS. 2 and 3 which in the region of the force introduction regions F2 and F3 comprises means for resilience and/or shock absorbing between the ski guide pressure reinforcement plate 14 and the ski 3. The resilience means and/or shock absorbing means 15 preferably contain a compression or tension spring and/or an air or oil cylinder or another elastic or damping element.

Figure 12:
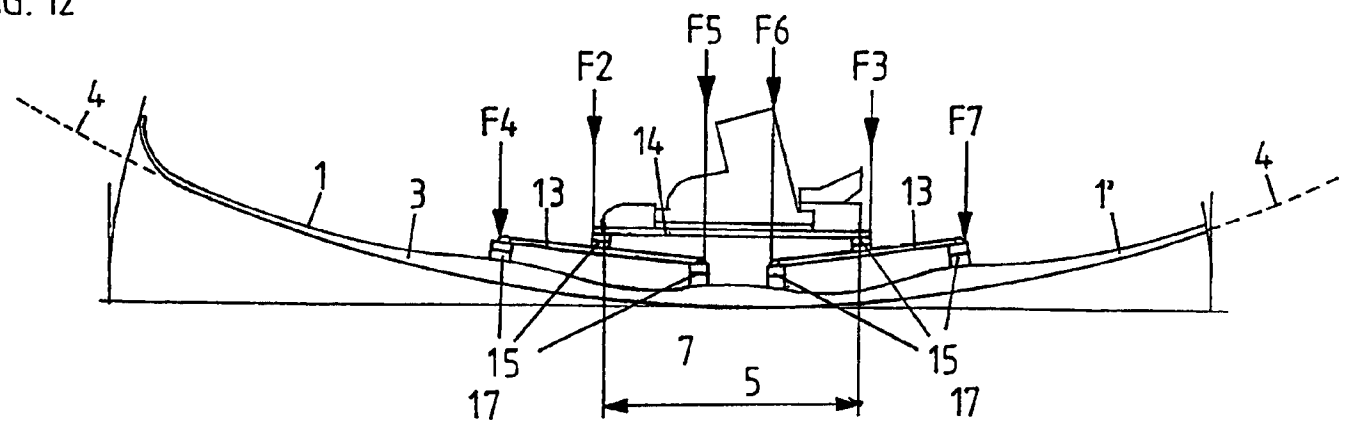

FIG. 12 shows a ski 3 according to this invention as described by FIG. 9 but which in the region of the force introduction regions F2 and F3 comprises means 15 for resilience and/or shock absorbing between the ski guide pressure reinforcement plate 14 and the force transmission tabs 13, and/or in the region of the force introduction regions F4, F5, F6, F7 comprises means for resilience and/or shock absorbing between the force transmission tabs 13 and the ski 3. The resilience means and/or the shock absorbing means 15 preferably contain a compression or tension spring and/or an air cylinder or oil cylinder or another elastic or damping element.

Figure 13:
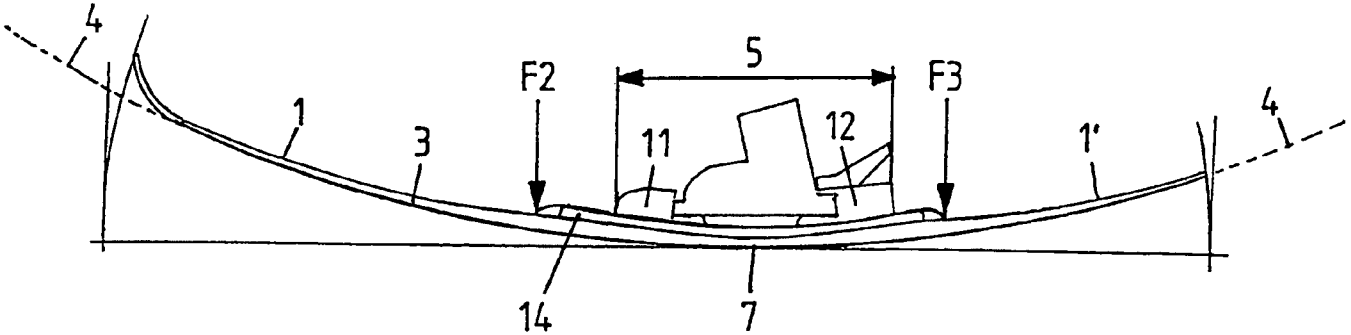

FIG. 13 shows a ski 3 according to this invention as described in view of FIGS. 2 and 3, equipped with a ski guide pressure reinforcement plate 14 which in its bending stiffness is computed so that during the travelled curve it bends so that it just corresponds to the radius for the ski 3 predefined by the ski manufacturer. In other words the main load of the intrinsic weight and the centrifugal force of the user or snow sportsman in the travelled curve is mainly introduced into the ski 3 at the force introduction regions F2 and F3 into the ski 3, while the ski guide pressure reinforcement plate 14 in the middle of the ski 7 only slightly contacts the ski 3. The ski guide pressure reinforcement plate 14 is assembled onto the ski 3 in the form of one or more plates, rails, tubes or other elements, or by various materials forms a unit with the ski 3, for example it is adhered to the ski 3.

Figure 14:
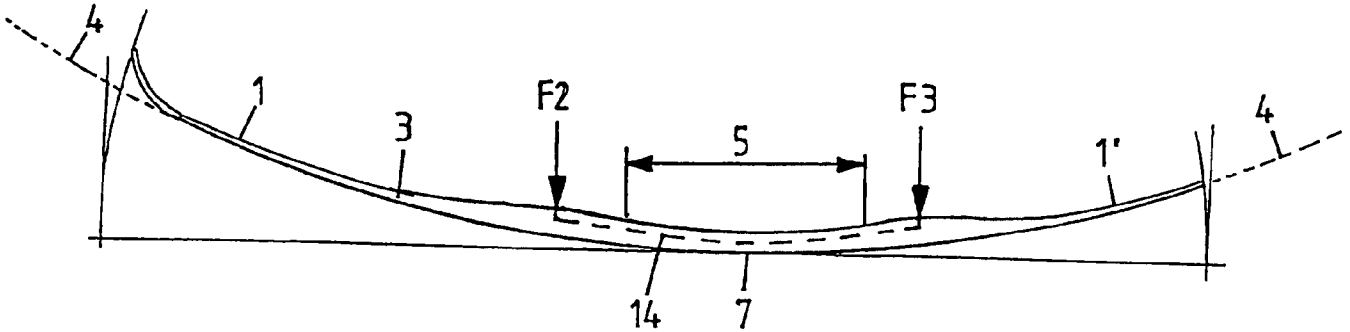

FIG. 14 shows a ski 3 according to this invention as described by way of FIGS. 2, 3, equipped with a specifically computed ski guide pressure reinforcement plate 14 as described in view of FIG. 13. The ski guide pressure reinforcement plate 14 or rail, tube or other elements are integrated in the ski 3 or are e.g. in the form of carbon fiber strips. Alternatively the force and/or bending stiffness for the bending of the specifically computed ski guide pressure reinforcement plate 14, in order to correspond to the predefined radius of the ski 3, may also be calculated into the thickness or bending stiffness of the ski 3 so that the force introduction of the user or snow sportsman is effected mainly via the force introduction regions F2 and F3.

Figure 16:
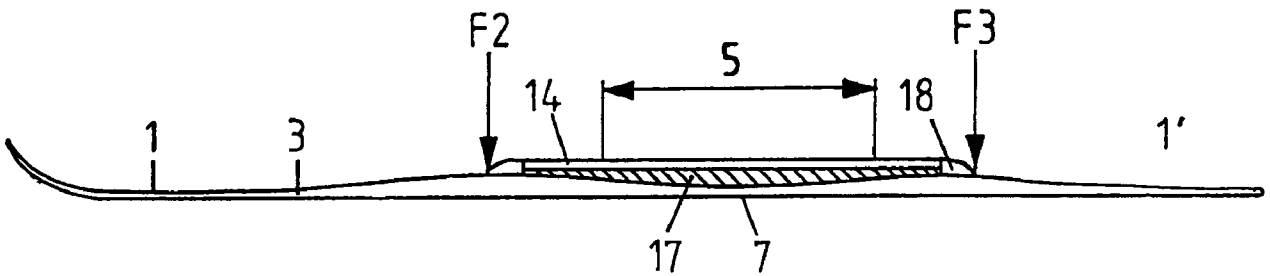
FIG. 16 shows a further embodiment form of the ski according to this invention in a lateral view.

The materials of the ski guide pressure reinforcement plate 14, rails, tubes or other elements and/or the materials of the ski or the materials which are integrated into the ski are e.g. connected to one another so that they permit a length compensation between the various materials (see FIG. 16). This may e.g. be achieved by one or more layers of elastic elements which in the longitudinal direction are installed onto or into the ski 3 and permit a length compensation between the individual layers of the various materials, or by other specific construction types which permit a length compensation.

Figures 15A, 15B:
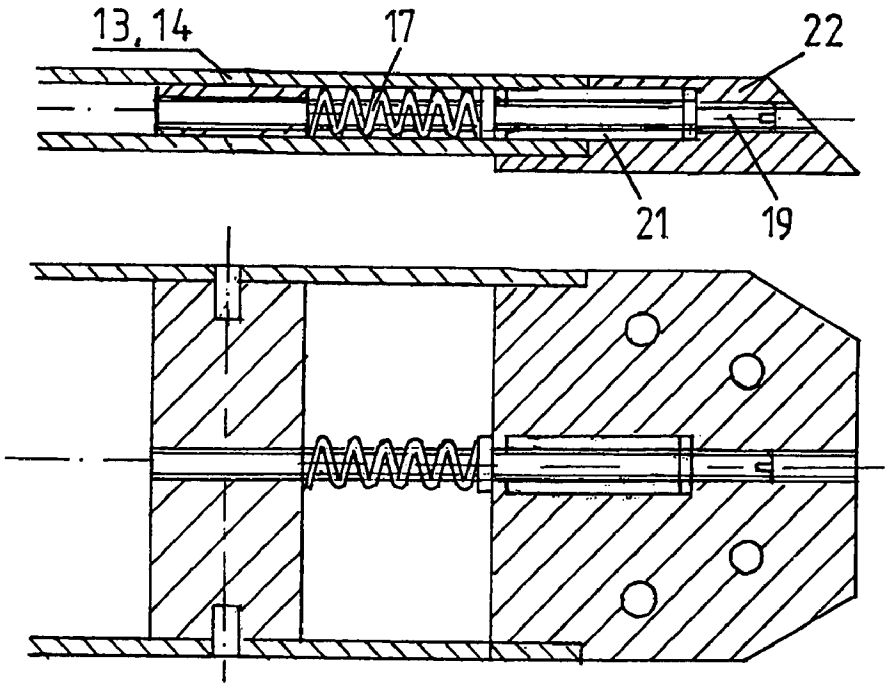
FIG. 15 shows a shock absorber device for the ski according to this invention: (a) in a cross section; and (b) in a longitudinal section.

In FIG. 15 there is shown one embodiment for the resilience and damping at the force introduction regions F2 and F3. Such a resilience and damping comprises a spring element 17, for example a helical spring or an elastic element (cf. element 18 in FIG. 16), and/or a damping element 21, for example an air or oil cylinder. The strength of the damping may be set by a setting mechanism 19 by which means the stiffness of the ski 3 may also be indirectly varied. The resilience and damping may be incorporated between the ski guide pressure reinforcement plate 14 and the ski 3, or in the ski guide pressure reinforcement plate 14. It may be integrated in the ski 3 or (as in FIG. 12) may be attached at the force introduction regions F4, F5, F6, F7 between the force transmission tabs 13 and the ski 3. The ski guide pressure reinforcement plate 14 or the force transmission tab 13 is fastened on the ski 3 by a fastening element 22. With the resilience and damping, shocks are absorbed by way of the bending of the ski 3 and in the reverse manner a recoil is produced. On bending of the ski 3 a potential force is produced which with the return to the natural position of the ski 3 is reduced again because the ski 3 is forced to return into the initial position.

FIG. 16 shows an alternative arrangement with resilience and damping on a ski 3 according to this invention. At least one elastic and/or damping material 17 is installed between the ski guide pressure reinforcement plate 14 and the ski 3. It also assists the length compensation between the ski guide pressure reinforcement plate 14 and the ski 3. It may be attached at the same locations as in FIG. 15 and produces a recoil in an analogous manner to that described by FIG. 15. The ski guide pressure reinforcement plate 14 is fastened on the ski 3 by an elastic and/or damping fastening element 18.

FIGS. 17-21 show various construction types, by which the ski according to this invention may be realized with various reinforced or reduced regions of stiffness. Without reinforcement in the region X the ski in the curve would bend uniformly in the region X+Y. With attached reinforcements the ski in the curve is forced to bend in the region Y between the attached reinforcements just as the ski would normally bend in the region X+Y. The region Y is loaded more for an equal bending. The material reaches its upper elasticity limit quicker which permits a higher force transmission while maintaining the good bending characteristics. The ski is stabilized in a more efficient manner and vibrations are better absorbed.

Figures 17, 18, 19, 20, 21:
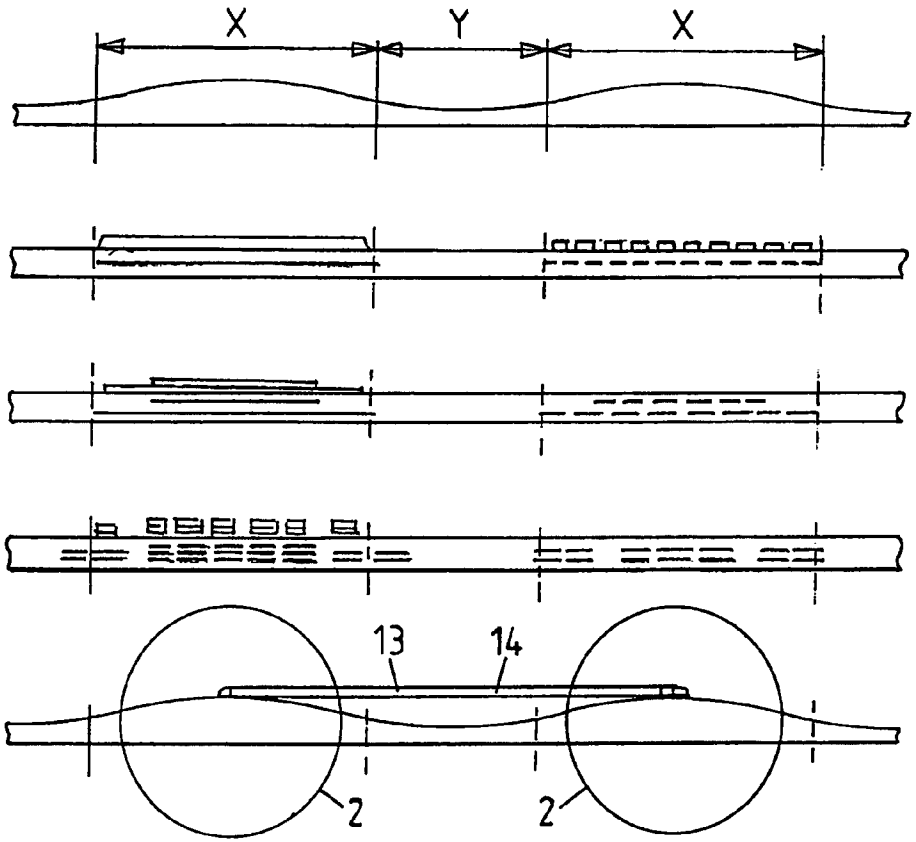
FIGS. 17-21 show schematic flexibility regions of the ski according to this invention, in longitudinal sections.

FIG. 17 shows cut-outs of a ski according to this invention with reinforced or reduced regions of bending stiffness, wherein the ski e.g. has thick or thin regions. Alternatively, the various bending stiffness regions may be realized with materials whose bending stiffnesses are different or with mixtures of different materials or specific construction types, which change the bending stiffness of the ski.

FIG. 18 shows cut-outs of a ski according to this invention with reinforced or reduced regions of bending stiffness, wherein on the ski or integrated into the ski there is attached a reinforcement in the form of a tab, a plate, of rails or tubes, of carbon fibers or of other elements which are attached in the longitudinal axis as one piece or as several pieces distanced to one another.

FIG. 19 shows cut-outs of a ski according to this invention with reinforced or reduced regions of bending stiffness, wherein on the ski or integrated in the ski a reinforcement in the form of several tabs, plates, rails, tubes, carbon fibers or other elements are attached in a layered manner, possibly different in length, in the longitudinal axis as one piece or several pieces distanced to one another.

FIG. 20 shows cut-outs of a ski according to this invention with reinforced or reduced regions of bending stiffness, wherein on the ski or integrated in the ski a reinforcement in the form of several tabs, plates, rails, tubes, carbon fibers or other elements are attached in a layered manner, possibly different in length, in one or several blocks, possibly in different lengths and differently distanced to one another.

Finally, FIG. 21 shows a ski 3 according to this invention in the region of the force transmission system 2 in that the ski comprises a reinforcement/reduction of the bending stiffness as explained in view of FIGS. 17-20 and/or on the ski or in the ski there is attached a force transmission tab 13 as described by way of FIG. 9, or a plate 14 as described by way of FIG. 16.

Other combinations of the above-cited embodiment forms are possible. With the knowledge of this invention it is also possible for the man skilled in the art to design further embodiment forms which accomplish the same or similar results as the subject matter of this invention.

INCORPORATION BY REFERENCE

The entire disclosure including the specification, the drawings and the claims of the parent co-pending U.S. patent application, having Ser. No. 09/914,275, filed on 15 Jan. 2002, entitled SKI GUIDE INTENSIFIER PRESSURE PLATE, is incorporated, by reference thereto, into this specification.

What is claimed:

1. A ski sport apparatus comprising:

a ski defining a longitudinal direction with a middle section and two outer sections;

an interface device with a binding region for accommodating a ski binding, the interface device connected to the ski in the middle section;

at least two force introduction regions at a distance from one another in the longitudinal direction for introducing forces from the interface device into the ski;

the ski having a plurality of regions of a lower flexibility or a higher flexibility alternating in the longitudinal direction; and the middle section of the ski having a thicker region with the higher flexibility between two thinner regions each having the lower flexibility, a frontmost force introduction region allocated to a frontmost of the two regions with the lower flexibility and in the longitudinal direction further to the front than the binding region, and a rearmost force induction region allocated to a rearmost of the two regions each with the lower flexibility and in the longitudinal direction arranged further to the rear than the binding region.

2. A ski sport apparatus according to claim 1, wherein force introduction regions are designed and arranged so that at least one of a force and a torque from an outer section of the ski is transmitted into the middle section of the ski and vice versa.

3. A ski sport apparatus according to claim 1, wherein the interface device in the longitudinal direction is rigid and at least partly one of articulately and elastically fastened into the force introduction regions on the ski, and the ski sport apparatus has a compensation for compensating a distance change between at least two of the force introduction regions.

4. A ski sport apparatus according to claim 1, wherein the interface device is bendable in the longitudinal direction and is designed and fastened on the ski so that it acts on the ski as a leaf spring.

5. A ski sport apparatus according to claim 1, wherein the interface device is bendable in the longitudinal direction and is firmly connected onto the ski.

6. A ski sport apparatus according to claim 1, wherein the interface device is bendable in the longitudinal direction and is integrated in the ski.

7. A ski sport apparatus according to claim 1, wherein the interface device contains at least one of at least one plate, at least one rail and at least one tube.

8. A ski sport apparatus according to claim 1, wherein the ski sport apparatus comprises at least one force transmission device for transmitting forces from the interface device to the force introduction regions, and wherein each force transmission device is connected on one side to two of the force introduction regions and on an other side to the interface device.

9. A ski sport apparatus according to claim 1, wherein on at least one of the interface device and one of the force introduction regions there is at least one of a spring element and a damping element.

10. A ski sport apparatus according to claim 1, wherein first regions of the ski having a low flexibility are formed as thick regions and second regions of a higher flexibility are formed as thin regions.

11. A ski sport apparatus according to claim 1, wherein regions of the ski with a lower flexibility are formed by at least one reinforcement attached one of on the ski and in the ski which permits no length compensation, in a form of at least one of at least one tab, at least one plate, at least one rail, at least one tube, carbon fibers, materials increasing a bending stiffness in the longitudinal direction as one part, and as several parts and distanced to one another.

12. A ski sport apparatus according to claim 1, wherein the interface device and one of the ski and longitudinal layers of the ski are connected among one another to permit a length compensation at transitions.

13. A ski sport apparatus according to claim 1, wherein regions of the ski with one of a lower and a higher flexibility result from at least one of an arrangement of materials with different bending stiffnesses, by mixtures of different materials and by specific construction types of the ski which change a bending stiffness of the ski.

14. A ski sport apparatus according to claim 1, wherein at least one of the two outer sections of the ski comprise several regions of one of lower flexibility and high flexibility alternating in the longitudinal direction.

15. A ski sport apparatus according to claim 1, wherein the middle section of the ski comprises several regions of a lower flexibility and high flexibility alternating in the longitudinal direction.

16. A ski sport apparatus according to claim 1, wherein at least one of an elastic material and a damping material is attached between the interface device and at least one of the ski and in the ski.

17. A ski sport apparatus according to claim 1, wherein a distance in the longitudinal direction between a frontmost force introduction region and a rearmost force introduction region is at least 650 mm, preferably 800 to 900 mm and maximally 1300 mm.

18. A ski sport apparatus according to claim 1, wherein the ski binding is at least one of integrated one of on and in the interface device and is at least one of displaceable in the longitudinal direction and permits a length compensation.

19. A ski sport apparatus according to claim 8, wherein the force transmission device is bendable in the longitudinal direction and is integrated in the ski.

20. A ski sport apparatus according to claim 8, wherein each force transmission device comprises at least one of at least one tab, at least one plate, at least one rail and at least one tube.

21. A ski sport apparatus according to claim 8, wherein on at least one of a force transmission device at a force introduction region and a connection between the interface device and the force transmission device there is at least one of a spring element and a damping element.

22. A ski sport apparatus according to claim 8, wherein at least one of an elastic material and a damping material is attached between the force transmission device and at least one of the ski and in the ski.

23. A ski sport apparatus comprising:

a ski defining a longitudinal direction with a middle section and two outer sections, the ski having a plurality of regions of a lower flexibility or a higher flexibility alternating in the longitudinal direction, and the middle section of the ski having a region with the higher flexibility;

an interface device with a binding region for accommodating a ski binding, the interface device connected to the ski in the middle section of the ski; and the interface device connected to the ski at two regions at a distance from one another in the longitudinal direction, at least one of a frontmost force introduction region and a rearmost force introduction region allocated to a thinner region of the ski with the lower flexibility, and in the longitudinal direction the frontmost force introduction region arranged further to a front of the ski than the binding region and the rearmost force introduction region arranged further to a rear of the ski than the binding region.

24. A ski sport apparatus comprising:

a ski, in a longitudinal direction the ski having a middle section positioned between a front section and a rear section, the ski having a front thickened region between the middle section and the front section, the ski having a rear thickened region between the middle section and the rear section; and an interface device, a binding region of the interface device positioned between a binding head and a heel automatic device, the interface device connected to the ski at the front thickened region forward of the binding head and at the rear thickened region rearward of the heel automatic device.

25. A ski sport apparatus according to claim 24, wherein the middle section has a flexibility that is higher than the front thickened region and that is higher than the rear thickened region.

26. A ski sport apparatus according to claim 24, wherein a thickness of the middle section is less than the front thickened region and that is less than the rear thickened region.

* * * * *

UNITED STATES PATENT AND TRADEMARK OFFICE

CERTIFICATE OF CORRECTION

PATENT NO. : 7,341,271 B2
APPLICATION NO. : 10/680708
DATED : March 11, 2008
INVENTOR(S) : Roland Bünter It is certified that error appears in the above-identified patent and that said Letters Patent is hereby corrected as shown below:

On the Title page, in the Title Item (54) delete "SPOT" and in its place insert

--SPORT--.

Signed and Sealed this

Fourth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,341,271 B2
APPLICATION NO. : 10/680708
DATED : March 11, 2008
INVENTOR(S) : Roland Bünter It is certified that error appears in the above-identified patent and that said Letters Patent is hereby corrected as shown below:

On the Title page, in the Title Item (54) and Column 1, line 1, delete "SPOT" and in its place insert --SPORT--.

This certificate supersedes the Certificate of Correction issued November 4, 2008.

Signed and Sealed this

Twenty-fifth Day of November, 2008

JON W. DUDAS
*Director of the United States Patent and Trademark Office*